United States Patent [19]

Carter

[11] 4,012,687

[45] Mar. 15, 1977

[54] DRIVER AMPLIFIER FOR ADJUSTABLE HIGH VOLTAGE POWER SUPPLY

[75] Inventor: Elbert P. Carter, Wilmington, Del.

[73] Assignee: E. I. Du Pont de Nemours and Company, Wilmington, Del.

[22] Filed: Aug. 7, 1975

[21] Appl. No.: 602,758

[52] U.S. Cl. ..... 323/22 V; 323/22 T; 323/23

[51] Int. Cl.[2] ..... G05F 1/52; G05F 1/56

[58] Field of Search ..... 323/19, 22 T, 22 V, 323/ 23, 25

[56] References Cited

UNITED STATES PATENTS

| | | | |
|---|---|---|---|
| 3,458,801 | 7/1969 | Polson | 323/22 T |
| 3,581,187 | 5/1971 | Grady | 323/22 T |
| 3,599,081 | 8/1971 | Bryndza | 323/22 T |
| 3,772,606 | 11/1973 | Waehner | 323/23 UX |

*Primary Examiner*—A. D. Pellinen

[57] ABSTRACT

An adjustable series regulated high voltage power supply having a high slew rate is capable of providing relatively low output voltages. This capability is provided by the use of a unique coupling circuit between the control voltage amplifier for the supply and the series pass tubes. This coupling circuit provides a high negative voltage offset in order to accommodate the operating characteristics of the high voltage tubes by the use of a differential driver amplifier. The differential amplifier has inverting and non-inverting inputs. A constant bias is applied to the inverting input to establish a constant current through a voltage divider network having a tap coupled to the non-inverting input of the amplifier. The divider is coupled from the plate of the control amplifier to the output circuit of the supply. By selecting the values of the resistors in the voltage divider, the necessary voltage drop is obtained. A common collector amplifier provides bias for the cathodes of the series pass tubes with respect to their grids.

8 Claims, 1 Drawing Figure

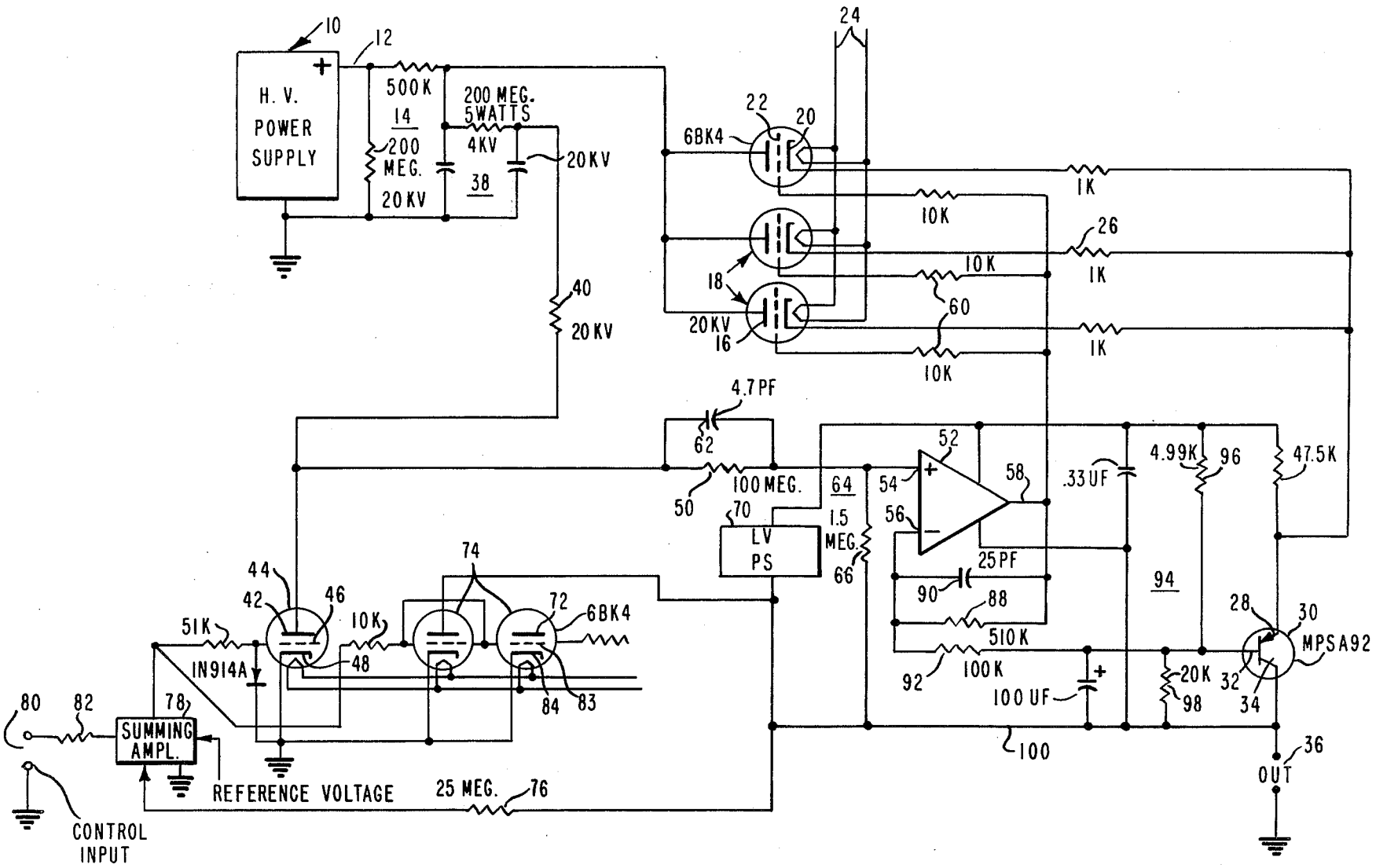
H. V. POWER SUPPLY
500K
14
200 MEG.
20 KV
200 MEG. 5 WATTS
4KV
38
20 KV
40
20 KV
6BK4
22
20
24
1K
26
1K
1K
10K
10K
60
10K
18
20 KV
16
4.7PF
62
100 MEG.
50
64
1.5 MEG.
66
LV PS
70
52
54
56
58
25PF
88
90
510K
92
100K
100 UF
100
4.99K
96
.33UF
47.5K
94
20K
98
28
30
MPSA92
32
34
36
OUT
6BK4
72
74
83
84
76
25 MEG.
10K
48
46
44
42
IN914A
51K
REFERENCE VOLTAGE
78
SUMMING AMPL.
82
80
CONTROL INPUT

DRIVER AMPLIFIER FOR ADJUSTABLE HIGH VOLTAGE POWER SUPPLY

BACKGROUND OF THE INVENTION

This invention relates to a high voltage power supply and, more particularly, to an adjustable high voltage power supply.

It is necessary in many applications to provide a regulated, high voltage power supply having a relatively high slew rate. This is particularly true in the field of mass spectrometry and related fields wherein high voltages typically in excess of 10,000 volts are varied, in order to sweep the ions and other particles being examined, down to voltages as low as 500 volts in short periods of time. These voltages must be accurate, stable, and have low noise.

Conventional couplings between the control voltage amplifier and the series pass tubes of a high voltage power supply have been found to be inadequate in that the operating characteristics of the high voltage tubes are such that it is extremely difficult if not impossible in most cases to obtain voltages much below 1500 volts with the retention of the low noise characteristics and the high slew rate for the power supply. If one is going to sacrifice the low noise criteria or if one is willing to sacrifice or settle for a slower slew rate of the power supply, conventional supplies often are adequate.

Accordingly, it is an object of this invention to provide an improved high voltage power supply having a high slew rate.

Another object of this invention is to provide an improved adjustable high voltage power supply which is relatively free from noise.

BRIEF SUMMARY OF THE INVENTION

A conventional high voltage, direct current power supply is adapted according to a preferred embodiment of the invention, to provide an adjustable output voltage in response to an input control signal. The power supply has an output load circuit, an electron flow device having a flow control electrode connected in series between the output circuit and the high voltage source, and a control amplifier responsive to the control voltage for driving said control electrode. The supply is adapted to provide a low noise, high voltage output having a relatively high slew rate by the use of a differential, driver amplifier having a pair of inputs and an output coupled to the control electrode and fedback to one of the inputs of the amplifier, means to apply a bias voltage to the one amplifier input, a voltage divider network having a tap coupled to the other input of the amplifier, said network being adapted to couple the control amplifier to the driver amplifier, thereby to provide a low noise constant voltage drop therebetween. This addition permits the high voltage output of the supply to be varied at a high rate of speed from relatively high voltages to relatively low voltages without the presence of excessive noises even at low output voltages.

In a particular preferred embodiment of the invention, bias means are coupled between the output circuit and the control electrode in the form of a transistor connected in a common collector mode, whose input circuit is connected to receive the bias voltage and whose output circuit is connected in series with the electron flow device. Further the voltage divider network may include a pair of resistors with a tap at the junction of the resistors, the resistors being connected in series between a control voltage source and the output circuit. A capacitor may be connected between the control voltage source and the tap to improve the speed of response of the supply to variations in control voltage.

DESCRIPTION OF THE DRAWINGS

Further advantages and features of this invention will become apparent upon consideration of the following description wherein the sole FIGURE is a partial block, partial schematic diagram of a high voltage power supply constructed in accordance with a preferred embodiment of this invention.

DESCRIPTION OF THE PREFERRED EMBODIMENTS

As seen in the sole FIGURE, there is a conventional high voltage power supply 10 capable of providing a unregulated high voltage output of typically 15–20,000 volts. The output 12 (with respect to ground) of this power supply 10 is coupled through a first RC filter network 14 to the plates 16 of parallel connected pass tubes 18. The pass tubes 18 may be any typical high voltage tube, having high voltage capability, such as the 6 BK4 or 6EL4-A. Each also has a cathode 20 and a control electrode 22. These pass tubes, as are the other tubes depicted, and connected to a suitable filament supply 24. In turn the cathodes 20 of the parallel connected pass tubes 18 are each connected through current limiting resistors 26 to the emitter electrode 28 of the PNP transistor 30 connected to operate in a common collector mode. The transistor 30 also has a base electrode 32 and a collector electrode 34, the latter electrode being connected to the output circuit 36 to which is provided a regulated high voltage output with respect to ground.

The output of the first RC filter 14 is connected through a second RC filter 38 thence through a suitable plate resistor 40 to the plate 42 of a control amplifier 44. The control amplifier, which may be formed of any suitable high voltage tube, such as those previously described, also has a control electrode 46 and a cathode 48. The plate electrode 42 of the control amplifier 44 is connected through a voltage dropping resistor 50 to the non-inverting input 54 of a driver amplifier 52. This driver amplifier may be a conventional differential input, operational amplifier having both the non-inverting input 54 and an inverting input 56. The output of the amplifier 58 is connected through parallel connected grid resistors 60 to the control electrodes 22 of the pass tubes 18. The voltage dropping resistor 50 may be bypassed by a small capacitor 62 to improve the response time of the circuit. The dropping resistor 50 is part of a voltage divider network 64 which includes a second resistor 66 connected to the output circuit 36 such that the junction between the voltage dropping resistor 50 and the second resistor 66 forms a tap which is connected to the non-inverting input of the driver amplifier 52.

In accordance with this invention, the ratio of the voltage dropping resistor 50 to the second resistor 66 is such that for the current flow which is established, as described hereinafter, through the second resistor 66, the voltage drop through the dropping resistor 50 provides the desired constant voltage drop from the plate of the control amplifier 42 to the input of the driver amplifier 52.

Operating voltage for the driver amplifier 52 is provided by a low voltage D.C. power supply 70 of conventional type, the negative terminal of which is connected to the high voltage terminal of the output circuit 36 that output voltage in turn is fed back through a resistor 76 to one input of a summing and reference amplifier denoted by the block 78. A second input to the summing and reference amplifier 78 is derived from a pair of control input terminals 80 through a summing resistor 82. The summing amplifier 78 may contain, as is conventional practice, a source of reference voltage such as that provided by a zener diode to compare the two summed inputs, i.e., the control input signal and the feedback signal, and provide a control signal which controls the output voltage of the power supply. The output of the summing amplifier 78 is connected to the grid 46 of the control amplifier 44 and to the grids 83 of the pull-down amplifiers 74.

The output of the driver amplifier 52 is connected through a parallel connected feedback resistor 88 and feedback capacitor 90 to the inverting input 56 of the driver amplifier. In addition the inverting input 56 is connected through a divider resistor 92 to a bias means 94. The same bias means is connected to the emitter electrode 32 of the common collector amplifier 30. The bias means 94 may comprise a pair of series connected resistors 96 and 98 connected in series across the low voltage power supply 70. The junction between these two resistors provides the bias voltage both to the base electrode 32 and, through the divider resistor 92, to the inverting input 56 of the driver amplifier.

In operation, the unregulated high voltage from the power supply 10 is filtered and applied through the series pass tubes 18 and through the common collector amplifier 30 to the output circuit 36. The common collector amplifier 30, being operated by the fixed bias of the bias means 94, provides a constant negative cathode-grid bias for the series pass tube 18 by forcing the output rail 100, typically some 12 to 15 volts beneath that of the cathodes 20 of the pass tubes.

The output voltage from the output circuit 36 is fed back through the resistor 76 to the summing amplifier 78. At this point it is combined with a control voltage input which may be derived from any suitable source whose function is to provide a control signal to vary the voltage output of the power supply. In spectrometry usage the high voltage is varied typically from 500 volts up to 12,500 volts over a relatively short period of time. As is known, this summing amplifier compares the two control voltages to a reference voltage and provides a control voltage input to the control electrode 46 of the control amplifier 44. This varying input control voltage will cause changes in current flow to the plate resistor 40 and thereby apply an operating control voltage through the voltage dropping resistor 50 to the non-inverting input of the driver amplifier 52.

In accordance with this invention the bias means 94 applies a fixed bias through the divider resistor 92 to the inverting input of the driver amplifier 52. This fixed bias, because of the characteristics of the differential operational amplifier, causes the remaining input terminal, the non-inverting input, to assume a value that will be equal to that of the bias voltage. Thus, the non-inverting input terminal 54, which draws no significant input current, causes a sufficient current to flow through the divider resistor 66 of the divider network 64 to neutralize the effect of the bias applied to the bias means 94. This current thus causes the same current to flow through the voltage dropping resistor 50 thereby providing the desired voltage drop to the non-inverting input 54. With the illustrative values depicted in the drawing, this current flowing through the resistor 66 typically is ten microamperes which, when caused to flow through the voltage dropping resistor 50, produces a 1,000 volt drop between the plate 42 of the control amplifier and the non-inverting input of the driver amplifier.

This voltage drop is of low noise and relatively constant and compensates for the inability of the high voltage tubes to reduce their plate voltage much below 1500 volts without loss of control. This problem, which is encountered typically in high voltage tubes, is one which has severely limited the ability of varying the output of high voltage power supplies to much below 1500 volts. With this invention, however, this inability is overcome.

Zener diodes often have been employed in the past to provide this drop. They unfortunately provide a relatively high noise source particularly at the lower voltages and are undesirable. The driver amplifier is of relatively low noise and couples the plate of the control amplifier to the grids of the pass tubes to provide a relatively stable, fast operation.

The capacitor 62 improves the response of the circuit by permitting relatively rapid changes in voltages to occur. Furthermore, the cathode-grid bias for the pass tube is provided by the common collector amplifier, being biased by the same bias means 94 which establishes the voltage drop for the driver amplifier 52.

The circuit thus described is relatively simple, economical of construction and capable of providing relatively rapid voltage changes in a high voltage power supply without the introduction of appreciable noise therein.

I claim:

1. In a high voltage direct current power supply having a source of direct current, high voltage adapted to provide an adjustable output voltage in response to an input control voltage from a source and an output circuit adapted to be connected to a load, an electron flow device, having a flow control electrode, connected in series between said output circuit and said source, and a control amplifier responsive to said control voltage for driving said control electrode, the improvement comprising:

a differential driver amplifier having a pair of inputs and an output coupled to said control electrode and one of said inputs, means to apply a bias voltage to one of said inputs, a voltage divider network having a tap coupled to the other of said inputs, said divider network coupling the output of said control amplifier to said driver amplifier and said output circuit thereby to provide a low noise, constant voltage drop between the output of said control amplifier and said driver amplifier which permits low output voltages in said output circuit.

2. A high voltage power supply as set forth in claim 1 which also includes a summing means adapted to algebraically sum said control voltage and the voltage at said output circuit before application to said control amplifier, thereby to regulate the voltage at said output circuit.

3. A high voltage power supply according to claim 2 which also includes a source of reference voltage coupled to said summing means.

4. A high voltage power supply according to claim 3 which also includes bias means coupled between said output circuit and said control electrode.

5. A high voltage power supply according to claim 4 wherein said bias means includes a transistor connected in a common collector mode and having an input circuit connected to receive said bias voltage and an output circuit connected in series with said electron flow device.

6. A high voltage power supply according to claim 1 which also includes bias means coupled between said output circuit and said control electrode.

7. A high voltage power supply according to claim 6 wherein said bias means includes a transistor connected in a common collector mode and having an input circuit connected to receive said bias voltage and an output circuit connected in series with said electron flow device.

8. A high voltage power supply according to claim 1 wherein said divider network includes a pair of resistors connected in series, with said tap at the junction of said resistors, between said control voltage source and said output circuit.

* * * * *